US005115785A

United States Patent [19]

Cook

[11] Patent Number: 5,115,785

[45] Date of Patent: May 26, 1992

[54] CARBON CANISTER PURGE SYSTEM

[75] Inventor: John E. Cook, Chatham, Canada

[73] Assignee: Siemens Automotive Limited, Chatham, Canada

[21] Appl. No.: 674,626

[22] Filed: Mar. 25, 1991

Related U.S. Application Data

[63] Continuation-in-part of Ser. No. 517,285, May 1, 1990, abandoned.

[51] Int. Cl.[5] ..... F02M 39/00

[52] U.S. Cl. ..... 123/520; 123/516

[58] Field of Search ..... 123/518, 519, 520, 521, 123/458; 251/30.01; 137/907

[56] References Cited

U.S. PATENT DOCUMENTS

| | | | |
|---|---|---|---|
| 4,044,743 | 8/1977 | Eaton | 123/520 |
| 4,086,897 | 5/1978 | Tamura | 123/520 |
| 4,127,097 | 11/1978 | Takimoto | 123/520 |
| 4,308,842 | 1/1982 | Watanabe | 123/519 |
| 4,527,532 | 7/1985 | Kasai | 123/520 |
| 4,700,683 | 10/1987 | Uranishi | 123/520 |
| 4,703,737 | 11/1987 | Cook | 123/520 |
| 4,741,317 | 5/1988 | Yost | 123/519 |
| 4,951,637 | 8/1990 | Cook | 123/519 |
| 5,069,188 | 12/1991 | Cook | 123/520 |

*Primary Examiner*—Carl Stuart Miller

*Attorney, Agent, or Firm*—George L. Boller; Russel C. Wells

[57] ABSTRACT

A pulse width modulated solenoid-actuated valve and a vacuum-actuated valve for cooperatively associated such that the purge system possesses both accurate control at low purge flows and the capacity for handling much higher flows. The two valves are in parallel paths between the canister and the manifold. Below a certain duty cycle of the solenoid-actuated valve, only its path is open. At higher duty cycles, both flow paths are open. An orifice is provided in the flow path containing the solenoid-actuated valve so that as this valve increasingly opens, a vacuum signal at a tap between the orifice and the solenoid-actuated valve also increases. This vacuum signal is applied to a control port of the vacuum-actuated valve to cause the latter to open upon attainment of a certain flow through the solenoid-actuated valve.

16 Claims, 6 Drawing Sheets

CARBON CANISTER PURGE SYSTEM

REFERENCE TO A RELATED APPLICATION

This application is a continuation-in-part of application Ser. No. 07/517,285 filed May 1, 1990 and now abandoned.

FIELD OF THE INVENTION

This invention relates to canister purge systems of the type that are used in automotive vehicle evaporative emission control systems for the controlled purging of a fuel vapor collection canister to the intake manifold of the vehicle's engine.

BACKGROUND AND SUMMARY OF THE INVENTION

The canister purge system controls the flow and rate of flow of fuel vapors from the collection canister to the intake manifold. One known type of canister purge system comprises a solenoid-operated valve which is under the control of the engine electronic control unit (ECU). A signal from the ECU to the valve solenoid determines the extent to which the valve restricts the flow of vapors from the canister to the manifold. Under conditions that are unfavorable to purging, the valve is fully closed. As conditions become increasingly favorable to purging, the valve is increasingly opened.

A suitably designed and operated pulse-width modulated solenoid-operated valve can exercise a rather precise degree of control over the purging, especially at those times when only small purge flow rates are permissible. On the other hand, compliance with a requirement for such precise low-flow control may limit the valve's capacity for handling much larger purge flow rates. Stated another way, building a higher flow version of the known valve will compromise low flow resolution, de-grading the control resolution at engine idle. Moreover, continued usage of the typical, fairly low, modulation frequency (10–16 hz) for higher flow rate control can introduce pulsations that adversely affect hydrocarbon constituents of engine exhaust.

The present invention is directed to a canister purge system that exhibits accurate control at low flow rates, and yet will handle much larger flow rates in a very acceptable manner. This capability is attained by the combination of a canister purge solenoid valve having an inlet, an outlet, and a valving means that is disposed in a passage between the inlet and outlet and imposes a selected restriction to flow through this passage in accordance with an electrical control signal delivered to the valve solenoid, and a normally-closed, vacuum-actuated valve having an inlet, an outlet, and a valving means that is disposed in a passage between the last-mentioned inlet and outlet and opens the last-mentioned passage to flow only for values of a vacuum signal input to a control port of the normally-closed, vacuum-actuated valve which exceed a certain minimum, first conduit means, including orifice means, for connecting the inlet and outlet of the canister purge solenoid valve to a canister and an engine intake manifold respectively, second conduit means for connecting the inlet and outlet of the normally-closed, vacuum-actuated valve to the canister and engine intake manifold respectively, and third conduit means connecting the control port of the normally-closed, vacuum-actuated valve to a tap that is disposed in that portion of the first conduit means which is between the orifice means and the canister purge solenoid valve.

In a first embodiment that is specifically illustrated in the drawings, the tap is disposed between the orifice means and the inlet of the canister purge solenoid valve, the canister purge solenoid valve and the normally-closed, vacuum-actuated valve are separate assemblies, and all three of the conduit means are external to the two valves.

In a second embodiment that is illustrated in the drawings, the two valves and orifice means are integrated into a unitary assembly.

A third embodiment that is specifically illustrated in the drawings and is like the first embodiment includes a pressure regulator disposed in that portion of the first conduit means between the outlet of the canister purge solenoid valve and the intake manifold. The pressure regulator compensates for changes in intake manifold vacuum such that over the effective range of the regulator the purge flow set by the solenoid-actuated valve through the first conduit means is rendered substantially unaffected by changes in intake manifold vacuum.

A fourth embodiment that is specifically illustrated in the drawings and is like the third embodiment includes the two valves and the pressure regulator integrated into the unitary assembly. The pressure regulator performs the same function in this fourth embodiment as does the pressure regulator of the third embodiment.

Further details and advantages of the invention will be seen in the ensuing description and claims, which should be considered in conjunction with the accompanying drawings. A presently preferred embodiment of the invention discloses the best mode contemplated for carrying out the invention.

DESCRIPTION OF THE PREFERRED EMBODIMENT

Figure 1:
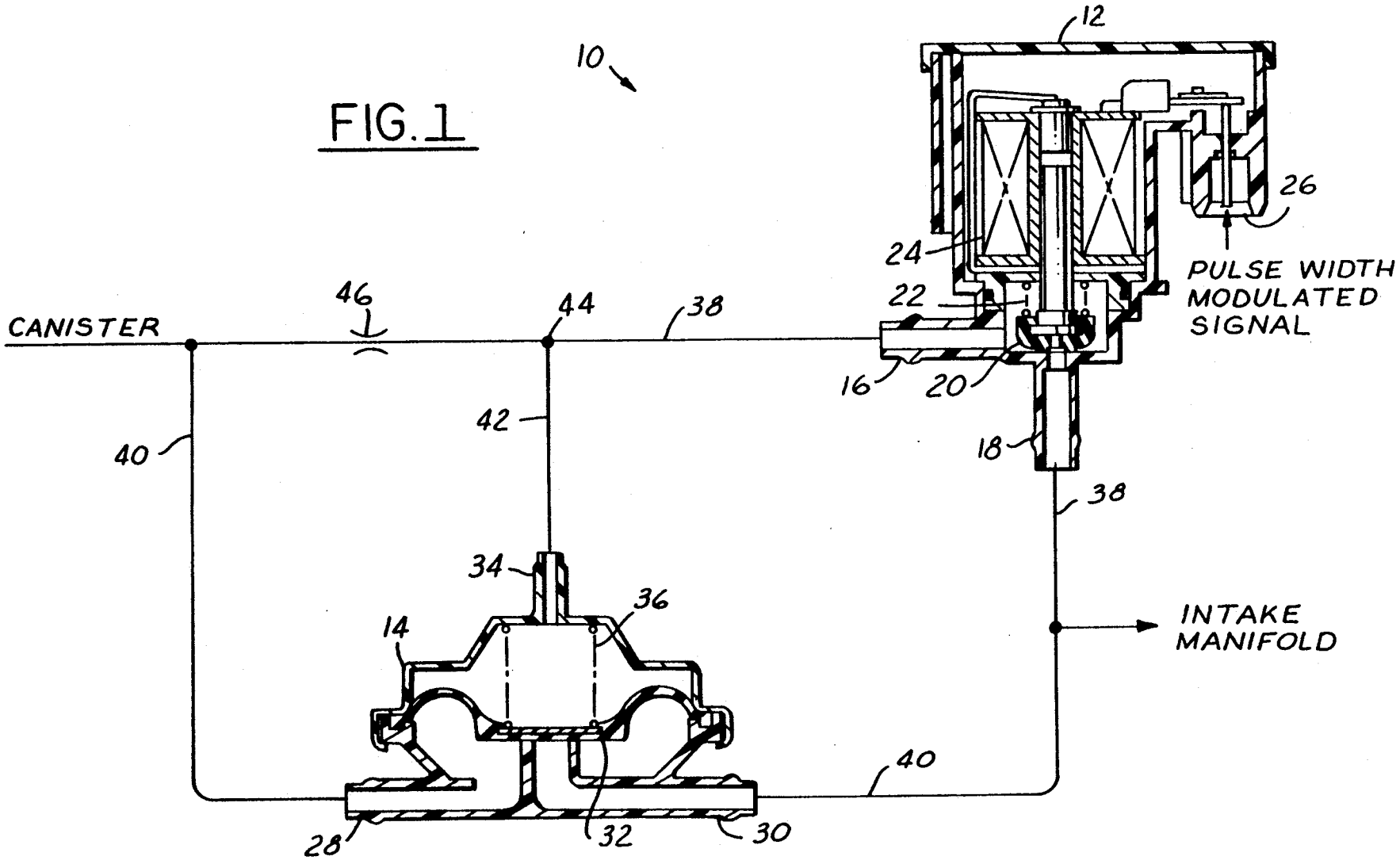
FIG. 1 is a schematic diagram, partly in cross section, of a first embodiment of canister purge system according to the present invention.

FIG. 1 displays a schematic illustration of a canister purge system 10 embodying principles of the invention. The system comprises a solenoid-actuated valve 12 and a vacuum-actuated valve 14, both of which are normally closed.

Solenoid-actuated valve 12 comprises an inlet nipple 16, an outlet nipple 18, and a valve member 20 that controls the degree of restriction that the valve imposes on flow from inlet nipple 16 to outlet nipple 18. A helical coil spring 22 biases valve member 20 to close the passageway between the inlet and outlet nipples. Valve member 20 has an armature that is disposed within a solenoid 24. Solenoid 24 is electrically coupled with the engine ECU (not shown) by means of an electrical terminal plug 26. The ECU delivers a pulse width modulated control signal to the solenoid for the purpose of selectively positioning valve member 20 within the valve against the bias force of spring 22. At and below a certain minimum pulse width, the degree of energization of solenoid 24 is insufficient for valve member 20 to be displaced against the spring bias, and so the valve remains closed. As the pulse width increases above this certain minimum, valve member 20 is increasingly displaced to correspondingly decrease the degree of restriction between nipples 16 and 18.

Figure 2:
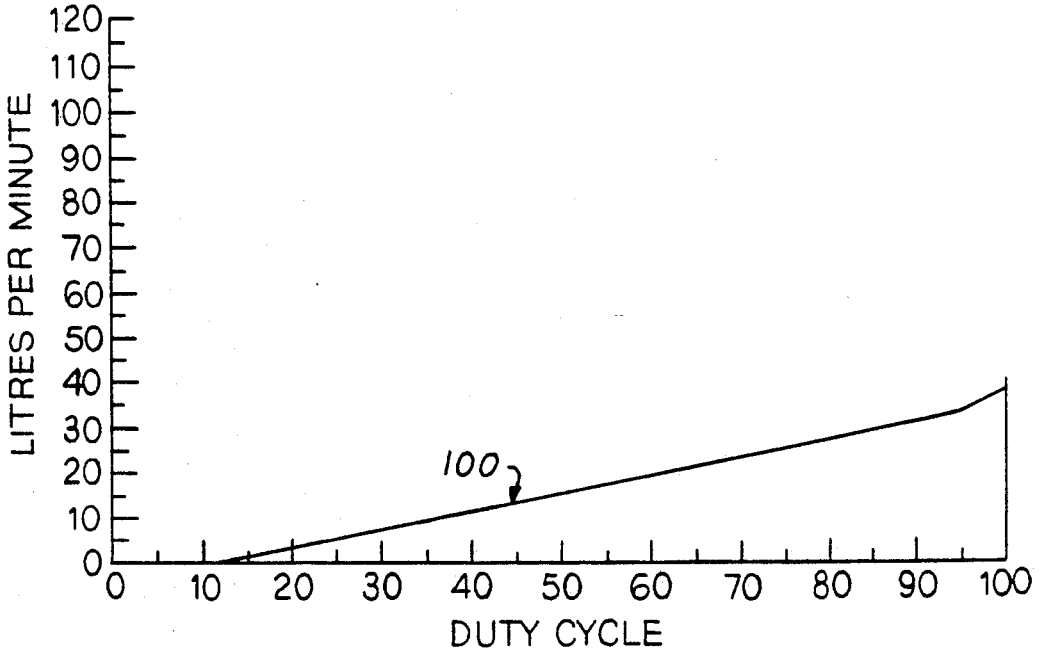
FIGS. 2 and 3 contain graph plots for comparing typical flow performance of the first embodiment of the invention with that of a prior valve.

The reference numeral 100 in FIG. 2 designates a graph plot of flow, in liters per minutes, vs. percent duty cycle of energization for a representative valve 12 by itself. The graph plot is reasonably linear, but the maximum rate that can be flowed through the valve is limited to about thirty-six liters per minute.

Figure 3:
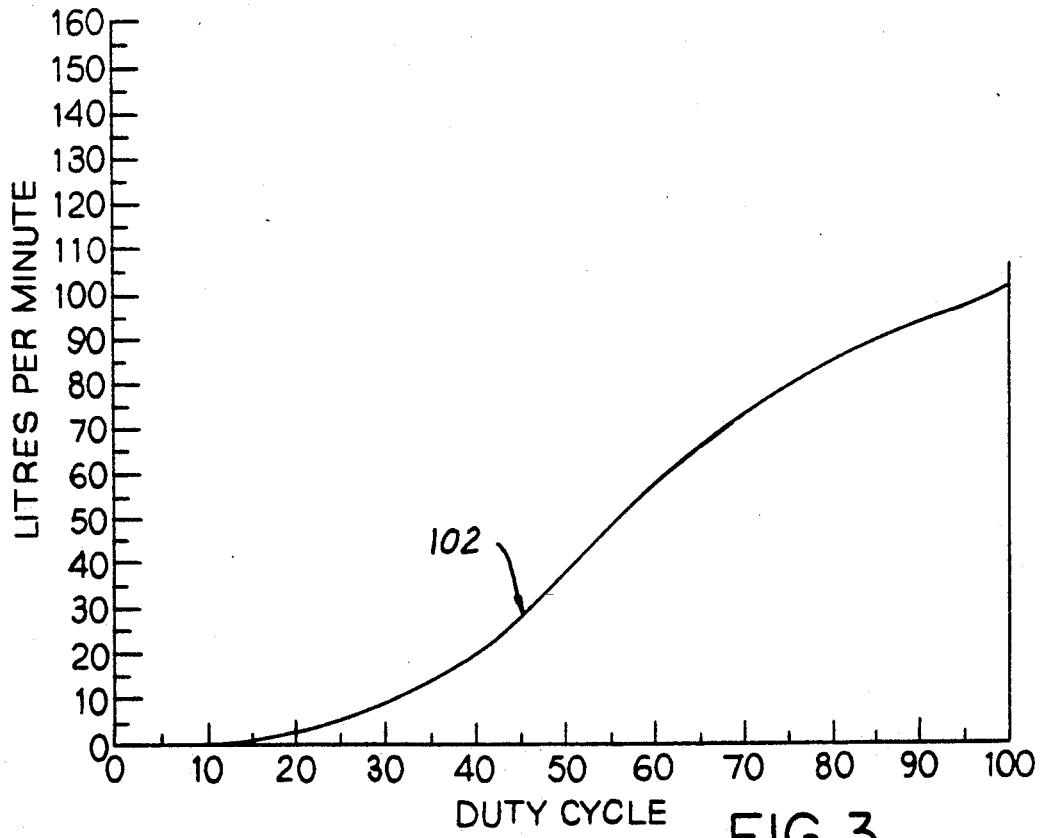

The improvement which is afforded by the present invention retains substantially the same flow vs. duty cycle characteristic up to about a 30% duty cycle, but enables substantially greater purge flows for larger duty cycles. The flow vs. percent duty cycle for a representative system of the improvement is designated by the reference numeral 102 in FIG. 3. The maximum flow rate is now increased to over one hundred liters per minute, a very substantial amplification.

The improvement afforded by the invention resides in the manner of association of valve 14 with valve 12. Valve 14 comprises an inlet nipple 28, an outlet nipple 30, and a diaphragm valve 32 that is positionable to open and close the passageway from inlet 28 to outlet 30 to flow in accordance with the magnitude of vacuum that is applied to the nipple of a control port 34. A helical coil spring 36 bias diaphragm valve 32 to close the passageway between nipples 28 and 30 to flow. The delivery of a sufficiently high vacuum to control port 34 will cause the diaphragm valve to overcome the spring bias and allow flow from nipple 28 to nipple 30.

The cooperation between the two valves 12 and 14 is provided by connecting valve 12 in a first conduit portion 38 extending from the vapor collection canister to the engine intake manifold, by connecting valve 14 in a second conduit portion 40 also extending from the canister to the manifold, and by connecting nipple 34 via a third conduit portion 42 to a tap 44 into the first conduit portion 38 between nipple 16 and an orifice 46, as shown.

The system operates in the following manner. As valve 12 is increasingly opened up to about a forty percent duty cycle, increasing flow is permitted from the canister to the manifold while valve 14 remains closed. As the flow through the first conduit portion 38 thusly increases, the vacuum applied to control port 34 also increases. At the forty percent duty cycle applied to valve 12, the vacuum at control port 34 is sufficiently large to cause valve 14 to begin to flow, and thereby create a second flow path from the canister to the manifold. Progressively increasing the duty cycle of valve 12 beyond the forty percent level results in a flow characteristic like that presented by the corresponding segment of the graph plot 102 of FIG. 3. As can be seen, this is substantially greater than the corresponding segment of the graph plot 100. Accordingly, the invention provides acceptable control resolution over its full operating range, especially at low flow rates, and the capacity for high flow rates at high duty cycles of valve 12. It can also be appreciated that the point at which valve 14 is allowed to open is calibratable by the selection of design parameters.

Figure 4:
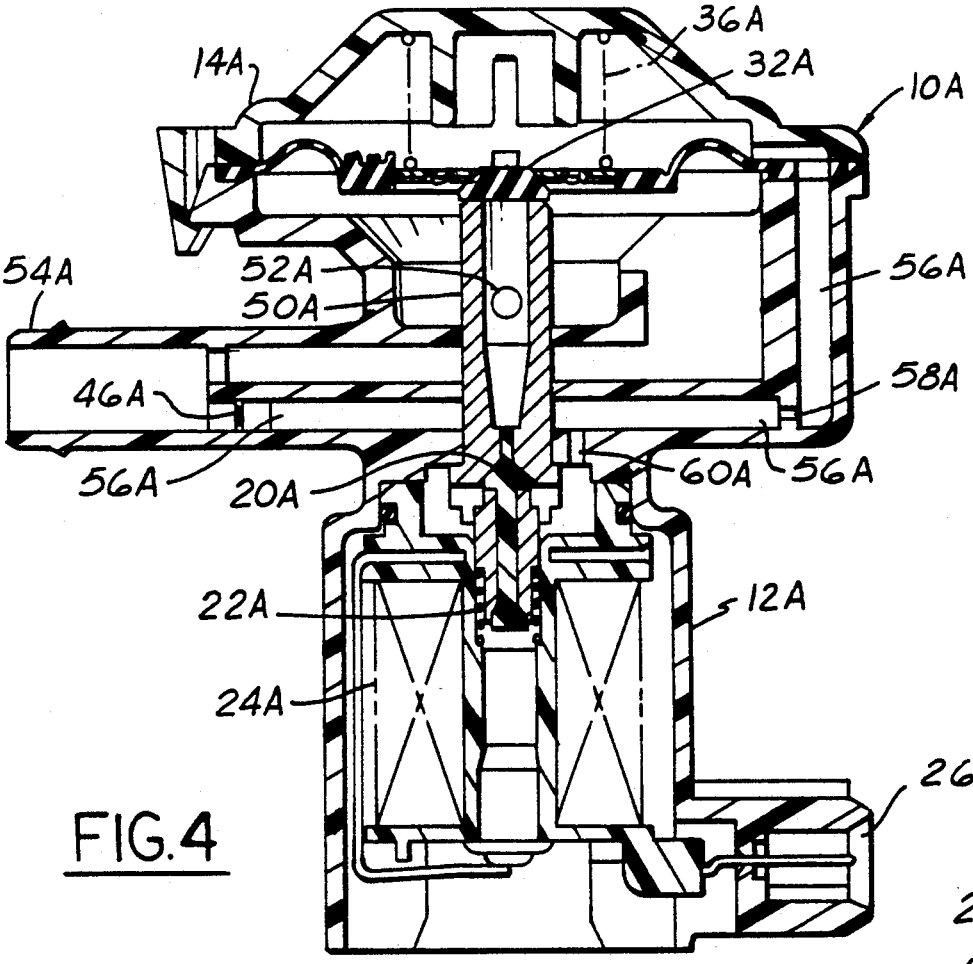
FIG. 4 is a cross sectional view through a second embodiment of the invention.

FIG. 4 illustrates a second embodiment in which a solenoid-actuated valve 12A, equivalent to solenoid-actuated valve 12, and a vacuum-actuated valve 14A, equivalent to vacuum-actuated valve 14, are integrated into a unitary assembly 10A. The equivalent of nipple 18, conduit portions 38 and 40, and nipple 30 is found in an internal tube 50A. The upper end of tube 50A as viewed in FIG. 4 provides a seat for the diaphragm valve 32A of vacuum-actuated valve 14A, which is equivalent to the diaphragm valve 32 of vacuum-actuated valve 14, while the lower end of the tube provides a seat for the valve member 20A of solenoid-actuated valve 12A, which is equivalent to the valve member 20 of solenoid-actuated valve 12.

The intake manifold is communicated to assembly 10A by means of a nipple 52A which extends to radially intercept tube 50A in the manner of a tee, as shown. The canister is communicated to assembly 10A by means of a nipple 54A. Internally, nipple 54A sub-divides into a passageway 56A leading to the chamber space of vacuum-actuated valve 14A which contains a spring 36A, equivalent to spring 36, that biases diaphragm valve 32A toward seating on tube 50A. Passageway 56A contains an orifice disc 46A, providing an orifice equivalent to orifice 46, and it also contains an orifice 58A between orifice disc 46A and vacuum-actuated valve 14A. Thus passageway 56A is equivalent to the flow path defined by elements 46, 44, 42, and 34 in the embodiment of FIG. 1.

The equivalent of elements 38 and 16 from FIG. 1 is found in a passageway 60A which tees into passageway 56A between orifice disc 46A and orifice 58A and extends to the seat side of valve member 20A. Other elements of FIG. 4 which are equivalent to corresponding elements of FIG. 1 are identified by the same numerals but with the addition of the suffix A.

The operation of assembly 10A is equivalent to the operation previously described for the first embodiment. The inclusion of orifice 58A is to damp vacuum changes so that transient fluttering of diaphragm valve 32A that might occur in response to sharp vacuum changes is attenuated, or even precluded.

Figure 5:
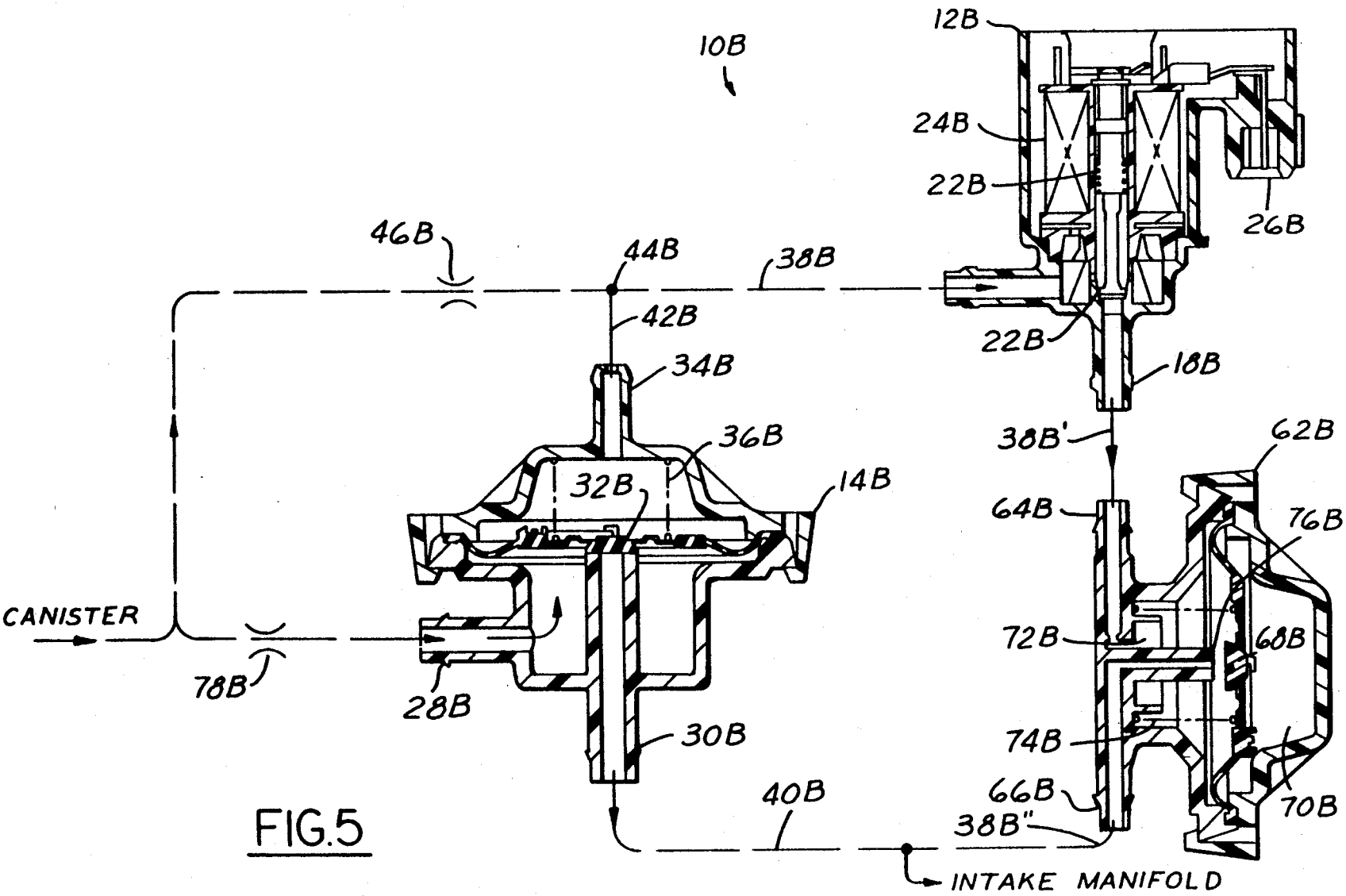
FIG. 5 is a schematic diagram, partly in cross section, of a third embodiment of canister purge system according to the present invention.

FIG. 5 presents a third embodiment which is a system 10B, equivalent to the system 10 of FIG. 1, but further including a pressure regulator 62B disposed between the intake manifold and the solenoid-actuated valve for the purpose of compensating for changes in intake manifold vacuum such that over the effective range of the pressure regulator the purge flow through the solenoid-actuated valve is rendered substantially unaffected by changes in intake manifold vacuum. Those elements of the third embodiment that are equivalent to corresponding elements of the first embodiment are designated in FIG. 5 by the same reference numeral used in FIG. but with the inclusion of the letter B as a suffix. A detailed description of such elements of FIG. 5 is therefore unnecessary.

Pressure regulator 62B comprises a first nipple 64B which connects to nipple 18B of solenoid-actuated valve 12B via a conduit 38B' and a second nipple 66B which connects via a conduit 38B" to intake manifold.

Within its interior the pressure regulator comprises a diaphragm valve 68B that divides the interior into two chambers. One chamber 70B is communicated to atmosphere; the other chamber 72B is in communication with nipple 64B. A helical spring 74B disposed in chamber 72B biases diaphragm valve 68B away from a valve seat 76B which is at the end of an internal passageway leading from nipple 66B. The pressure regulator is constructed and arranged such that the effective opening between valve seat 76B and diaphragm valve 68B is set by the magnitude of intake manifold vacuum relative to atmospheric pressure to prevent changes in vacuum from having substantial influence on a purge flow that is set by solenoid-actuated valve 12B.

FIG. 5 also shows the inclusion of an orifice 78B between the canister and nipple 28B. Orifice 78B is for the purpose of calibrating the flow rate through vacuum-actuated valve 14B at a particular set of conditions, and is really in the nature of a manufacturing convenience since a basic valve 14B can be fabricated and then calibrated by the use of a particular orifice size for orifice 78B. The same convenience can be incorporated into the other embodiments disclosed herein.

Figure 6:
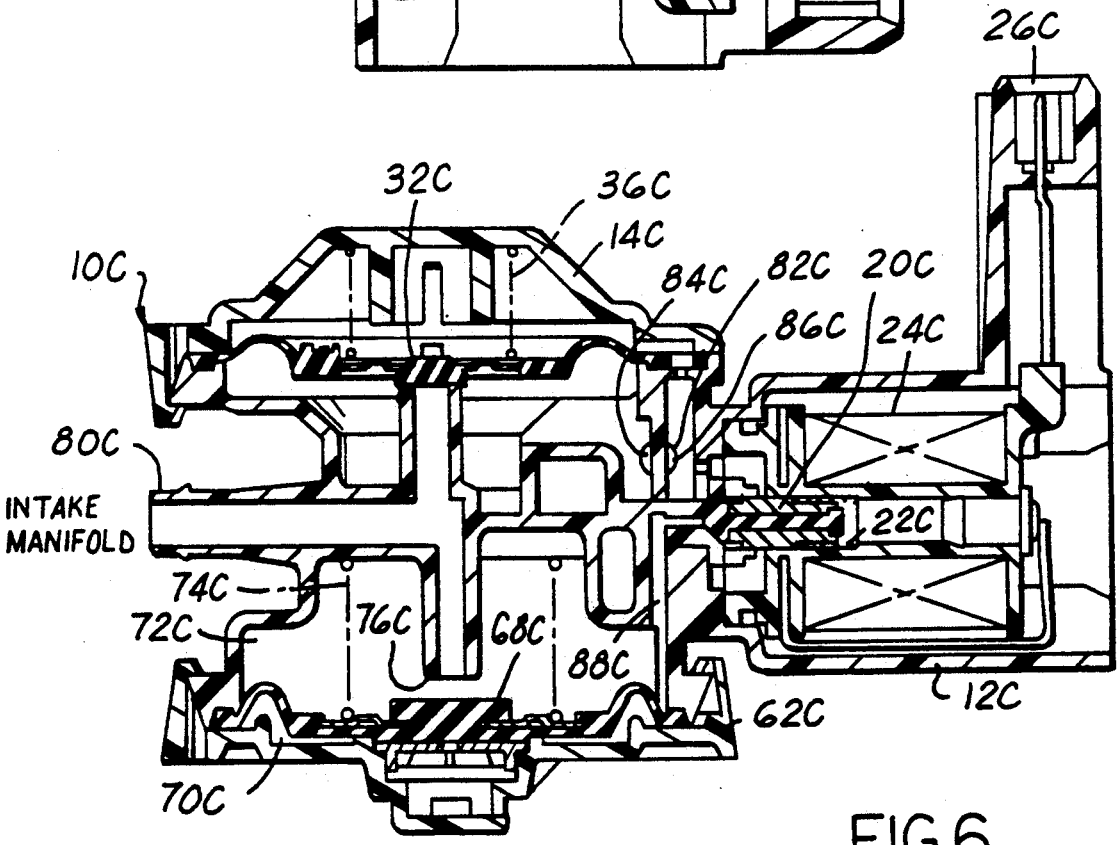
FIG. 6 is a cross sectional view through a fourth embodiment of the invention.

FIG. 6 shows a fourth embodiment 10C in which a solenoid-actuated valve 12C, equivalent to solenoid-actuated valve 12B, a vacuum-actuated valve 14C, equivalent to vacuum-actuated valve 14B, and a pressure regulator 62C, equivalent to pressure regulator 62B, are integrated into a unitary assembly 10C. Those elements of FIG. 6 which are equivalent to corresponding elements of the FIG. 5 embodiment are identified by the same base numerals, but with the suffix B changed to the suffix C. A detailed description of such elements is unnecessary and will not be given in the interests on conciseness.

A nipple 80C communicates assembly 10C to intake manifold, and a nipple 82C communicates the assembly to canister. Interior of assembly 10C, nipple 82C subdivides into a passageway 84C leading to vacuum-actuated valve 14C, equivalent to the flow path through orifice 78B and nipple 28B of FIG. 5, and to a passageway 86C that leads to both the seat side of solenoid-actuated valve 12C and the chamber of vacuum-actuated valve 14C that contains spring 36C. An internal passageway 88C extends from solenoid-actuated valve 12C to pressure regulator 62C and is equivalent to the flow path that is provided by elements 18B, 38B', and 64B in the embodiment of FIG. 5.

Assembly 10C functions in equivalent manner to the embodiment of FIG. 5.

Figure 7:
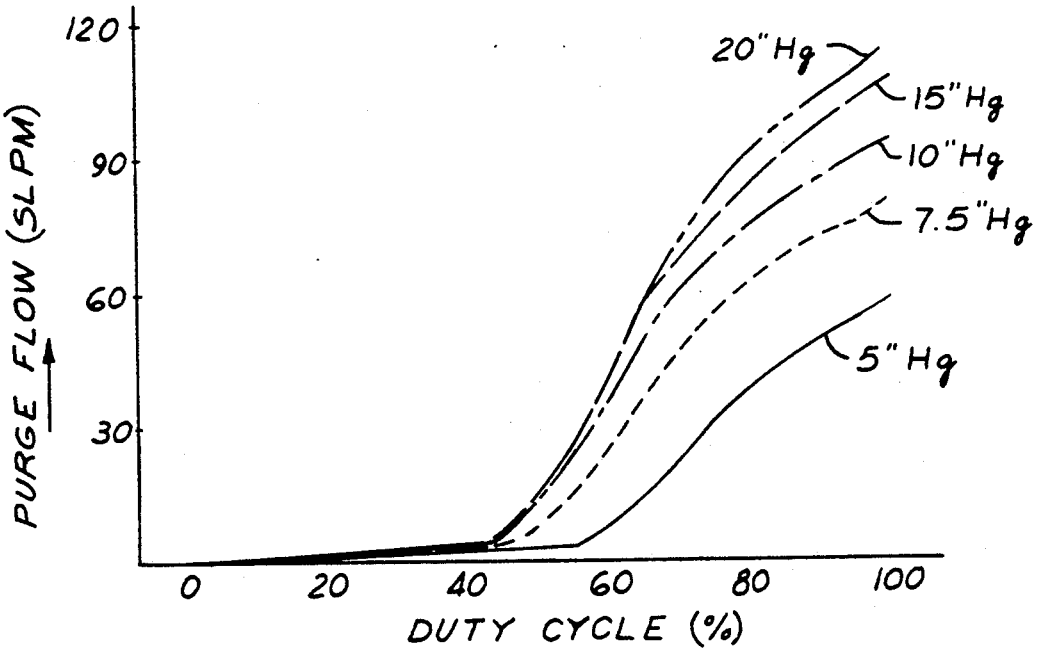
FIG. 7 is another graph plot depicting representative performance of the second embodiment.
Figure 7A:
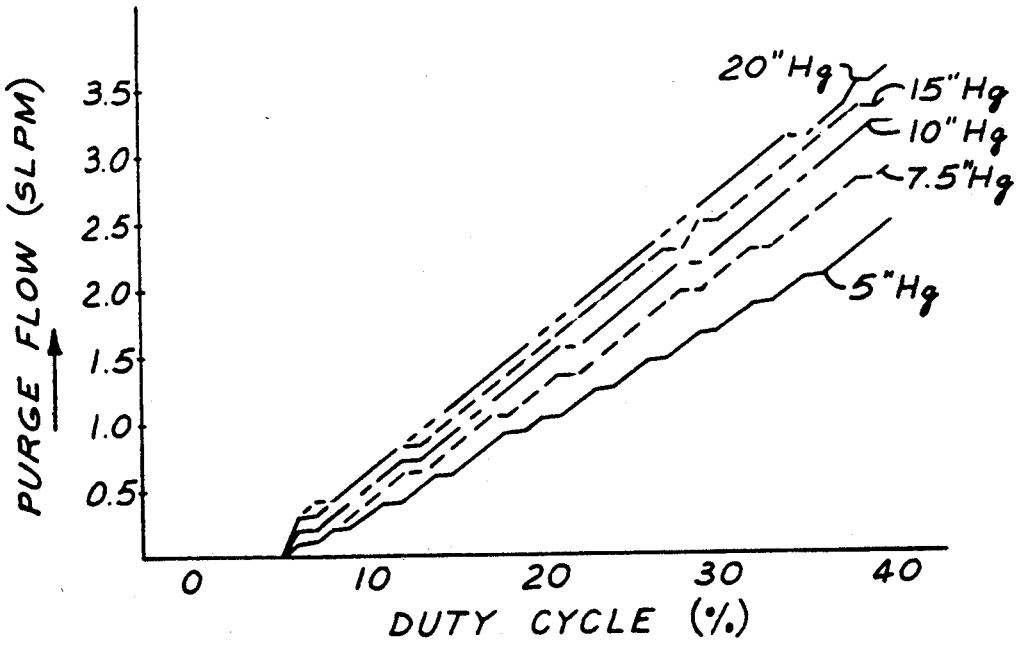
FIG. 7A is an enlargement of a portion of FIG. 7 to provide better resolution.

FIGS. 7 and 7A depict representative performance of an assembly such as that of FIG. 4. There are five plots of purge flow vs. duty cycle of a pulse width modulated signal applied to the solenoid-actuated valve for each of five different levels of manifold vacuum. Each plot has a distinctive dual-slope character wherein the lesser slope represents the low flow rate purging accomplished by the solenoid-actuated valve and the greater slope represents the higher flow rate purging that is accomplished by the vacuum-actuated valve.

Figure 8:
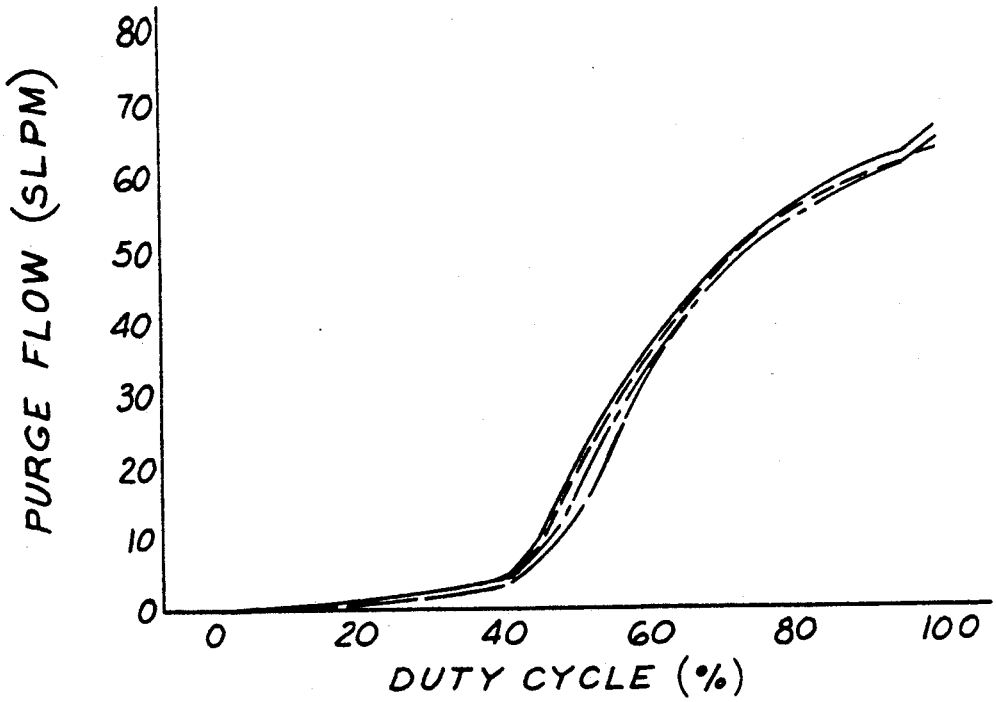
FIG. 8 is still another graph plot depicting representative performance of the fourth embodiment.
Figure 8A:
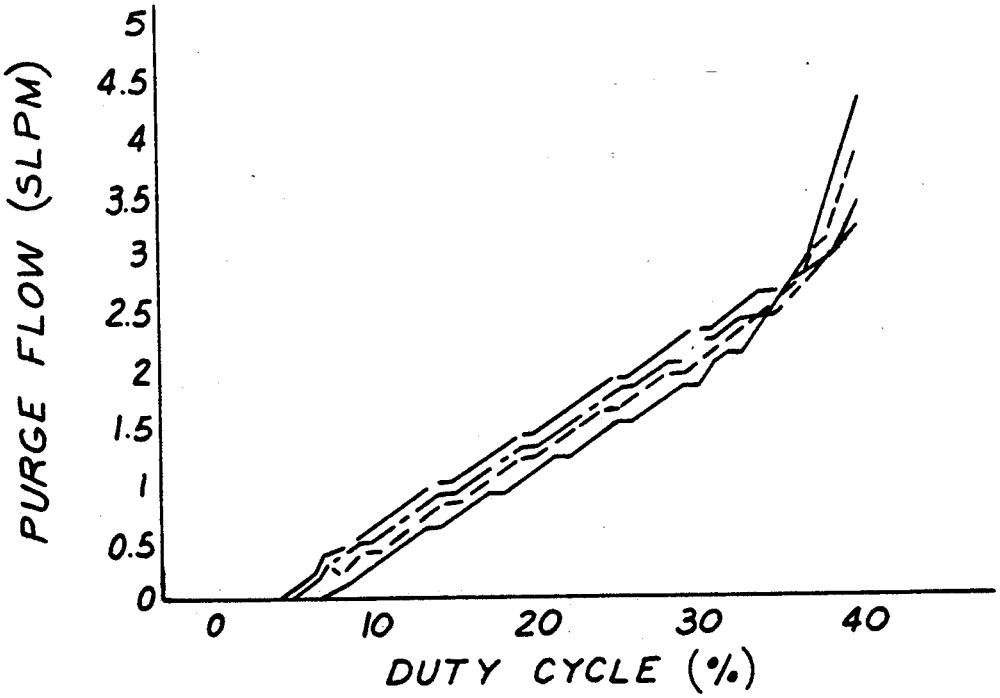
FIG. 8A is an enlargement of a portion of FIG. 8 to provide better resolution.

FIGS. 8 and 8A depict representative performance of an assembly such as that of FIG. 6. There are five plots of purge flow vs. duty cycle of a pulse width modulated signal applied to the solenoid-actuated valve for each of five different levels of manifold vacuum. Each plot has a distinctive dual-slope character wherein the lesser slope represents the low flow rate purging accomplished by the solenoid-actuated valve and the greater slope represents the higher flow rate purging that is accomplished by the vacuum-actuated valve. However, unlike the pressure unregulated plots of FIGS. 7 and 7A, the pressure regulated plots of FIGS. 8 and 8A are substantially coincident showing the effect of pressure regulation.

While a preferred embodiment of the invention has been illustrated and described, it should be appreciated that principles are applicable to other equivalent embodiments within the scope of the following claims.

What is claimed is:

1. A canister purge system for purging collected volatile fuel vapors from a canister to the intake manifold of an internal combustion engine comprising a canister purge solenoid valve having an inlet, an outlet, and a valving means that is disposed in a passage between said inlet and outlet and imposes a selected restriction to flow through said passage in accordance with an electrical control signal delivered to the solenoid of the valve, and a normally-closed, vacuum-actuated valve having an inlet, an outlet, and a valving means that is disposed in a passage between the last-mentioned inlet and outlet and opens said last-mentioned passage to flow only for values of a vacuum signal input to a control port of said normally-closed, vacuum-actuated valve which exceed a certain minimum, first conduit means, including orifice means, for connecting the inlet and outlet of said canister purge solenoid valve to a canister and an engine intake manifold respectively, second conduit means for connecting the inlet and outlet of said normally-closed, vacuum-actuated valve to such a canister and engine intake manifold respectively, and third conduit means connecting the control port of said normally-closed, vacuum-actuated valve to a tap that is disposed in said first conduit means between said orifice means and said canister purge solenoid valve.

2. A canister purge system as set forth in claim 1 in which said tap is disposed between said orifice means and the inlet of said canister purge solenoid valve.

3. A canister purge system as set forth in claim 1 in which said canister purge solenoid valve and said normally-closed, vacuum-actuated valve are separate assemblies, and all three of said conduit means are external to said valves.

4. A canister purge system for purging collected volatile fuel vapors from a canister to the intake manifold of an internal combustion engine comprising a canister purge solenoid valve section having an inlet, an outlet, and a valving means that is disposed in a passage between said inlet and outlet and imposes a selected restriction to flow through said passage in accordance with an electrical control signal delivered to a solenoid-actuated operating means for that valve section, and a normally-closed, vacuum-actuated valve section having an inlet, an outlet, and a valving means that is disposed in a passage between the last-mentioned inlet and outlet nd opens said last-mentioned passage to flow only for values of a vacuum signal input to a control port of said normally-closed, vacuum-actuated valve section which exceed a certain minimum, a first fluid passageway, including orifice means, providing fluid communication of the inlet and outlet of said canister purge solenoid valve section to a canister and an engine intake manifold respectively, a second fluid passageway providing a fluid communication of the inlet and outlet of said normally-closed, vacuum-actuated valve section to such a canister and engine intake manifold respectively, and a third fluid passageway providing fluid communication of the control port of said normally-closed, vacuum-actuated valve section to a tap that is disposed in said first fluid passageway between said orifice means and said canister purge solenoid valve section.

5. A canister purge system as set forth in claim 4 in which said tap is disposed between said orifice means and the inlet of said canister purge solenoid valve section.

6. A canister purge system as set forth in claim 5 in which said canister purge solenoid valve section and said normally-closed, vacuum-actuated valve section are contained in separate valve assemblies, and said fluid passageways comprise respective conduits that are external to said valve assemblies.

7. A canister purge system as set forth in claim 5 in which said canister purge solenoid valve section and said normally-closed, vacuum-actuated valve section are integrated into a unitary assembly.

8. A canister purge system as set forth in claim 7 in which said orifice means is also integrated into said unitary assembly.

9. A canister purge system as set forth in claim 4 including pressure regulating means comprising means compensating for changes in engine intake manifold vacuum such that over an effective range of said pressure regulating means, the purge flow set by said canister purge solenoid valve section is rendered substantially unaffected by changes in engine intake manifold vacuum.

10. A canister purge system as set forth in claim 9 in which said pressure regulating means is disposed in a portion of said first passageway between the outlet of said canister purge solenoid valve section and the engine intake manifold.

11. A canister purge system as set forth in claim 10 in which said canister purge solenoid valve section, said normally-closed, vacuum-actuated valve section, and said pressure regulating means are integrated into a unitary assembly.

12. A canister purge system as set forth in claim 11 in which said orifice means is also integrated into said unitary assembly.

13. A canister purge system as set forth in claim 12 in which said tap is disposed between said orifice means and the inlet of said canister purge solenoid valve section.

14. A canister purge system as set forth in claim 9 in which said canister purge solenoid valve section, said normally-closed, vacuum-actuated valve section, and said pressure regulating means are separate assemblies, and said fluid passageways comprise respective conduits that are external to said valve sections.

15. A canister purge system as set forth in claim 9 in which said tap is disposed between said orifice means and the inlet of said canister purge solenoid valve section.

16. A canister purge system as set forth in claim 15 in which said pressure regulating means is disposed in a portion of said first passageway between the outlet of said canister purge solenoid valve section and the engine intake manifold.

* * * * *